United States Patent [19]

Kwasnik et al.

[11] 4,382,842

[45] May 10, 1983

[54] COKE DISTRIBUTING APPARATUS IN A SMOKE HOOD

[75] Inventors: Hans-Jurgen Kwasnik, Herne; Hans-Gunter Piduch, Bochum; Rolf Weiershausen, Dortmund, all of Fed. Rep. of Germany

[73] Assignee: Dr. C. Otto & Comp. G.m.b.H., Bochum, Fed. Rep. of Germany

[21] Appl. No.: 299,115

[22] Filed: Sep. 3, 1981

[30] Foreign Application Priority Data

Sep. 12, 1980 [DE] Fed. Rep. of Germany ..... 3034391

[51] Int. Cl.[3] ..... C10B 33/14; C10B 45/00

[52] U.S. Cl. ..... 202/263; 414/210

[58] Field of Search ..... 202/262, 263, 270, 239; 414/210, 212

[56] References Cited

U.S. PATENT DOCUMENTS

| | | | |
|---|---|---|---|
| 4,053,068 | 10/1977 | Gidick | 202/262 |
| 4,082,753 | 4/1978 | Rogers et al. | 202/263 |
| 4,106,642 | 8/1978 | Hayduk | 202/262 |
| 4,113,572 | 9/1978 | Manda et al. | 202/262 |
| 4,123,334 | 10/1978 | Emery | 202/262 |
| 4,142,942 | 3/1979 | Calderon | 202/263 |
| 4,213,827 | 7/1980 | Calderon | 202/263 |

*Primary Examiner*—Bradley Garris

*Attorney, Agent, or Firm*—Thomas H. Murray; Clifford A. Poff

[57] ABSTRACT

A smoke collecting hood traversable on the oven platform along a coke oven battery covers the space in which the pushed coke cake drops into a quenching car while parked in front of the oven chamber. A distributor is suspended from the roof of the hood. The distributor includes metal sheets receding from a central vertical edge facing the oven. The sheets widen outwardly toward the bottom. A linkage is mounted on the distributor at the side remote from the oven to extend through the outer wall of the hood. Outside the hood, a drive is coupled to the linkage to pivot the distributor member about a horizontal axis. The distributor is vertically positioned at the start of the pushing operation so that its vertical front edge cuts through the coke cake and the coke slides down the sides of the distributor into the front and rear parts of the quenching car. Near the end of the pushing operation, the distributor is pivoted rearwardly and the remainder of the coke cake falls into the middle part of the quenching car.

5 Claims, 3 Drawing Figures

COKE DISTRIBUTING APPARATUS IN A SMOKE HOOD

BACKGROUND OF THE INVENTION

This invention relates to apparatus for use during the pushing of a hot coke cake from an oven chamber in a battery of horizontal coke ovens through a coke guide grid and into a smoke collector hood covering a coke car during the pushing operation. More particularly, the present invention relates to apparatus to distribute such a hot coke cake in a smoke hood for passage into the coke car.

The distribution of hot coke in a coke car or quenching car can be carried out without difficult if the coke car traverses along the battery of coke ovens during the coke cake pushing operation. A thin or low layer of coke is deposited on the inclined surface of the quenching car as it moves transversely to the oven chamber. However, distribution of coke becomes difficult to achieve if the car is stopped in front of an oven chamber during the coke pushing operation, as commonly occurs with a one-point coke car. Devices are known in the art for distributing a collapsing coke cake over the length of a container into which the coke is received. Such devices are complicated and in some cases require a special construction for the coke receiving container, which is usually a car.

SUMMARY OF THE INVENTION

It is an object of the present invention to provide apparatus to uniformly distribute a collapsing coke cake over a receiving container while using a simplified form of such a container.

According to the present invention, there is provided a distributor suspended from a smoke hood and disposed in the path of a hot coke cake pressed from an oven chamber to laterally deflect the coke cake, the distributor being supported for pivotal movement away from the oven chamber out of the path of the coke cake, the distributor member being pivotally moved preferably by actuator means provided on the outside of the hood.

In the preferred form of the present invention, the distributor includes a member having a front wall facing the oven chamber and formed by metal sheets receding from a middle vertical coke-confronting edge. The metal sheets widen outwardly and downwardly under the smoke hood.

The distributor includes a linkage mounted on the back wall surface thereof remote from the oven chamber. The linkage is passed through openings in an outer wall of the hood for supporting and positioning the distributor member. A drive for pivoting the distributor member out of a vertical position into a rearwardly-inclined position is provided on the outer wall of the hood. The linkage is constructed in a manner to withstand the considerable forces imposed on the distributor member in its vertical position by the coke cake which is pushed through the oven chamber by a pusher head. In the vertical position, the distributor member presents a front edge which cuts through the coke cake emerging from the guide grid whereby the coke slides laterally and downwardly into the front and rear parts of a coke receiving container with respect to its direction of travel such that the middle part of the container is still free of an accumulation of coke. The distributor member is then moved away from the oven chamber such that the remainder of the coke cake can fill the middle part of the coke receiving container, thus insuring filling the container with a uniform layer of coke.

These features and advantages of the present invention as well as others will be more fully understood when the following description is read in light of the accompanying drawings, in which.

Figure 1:
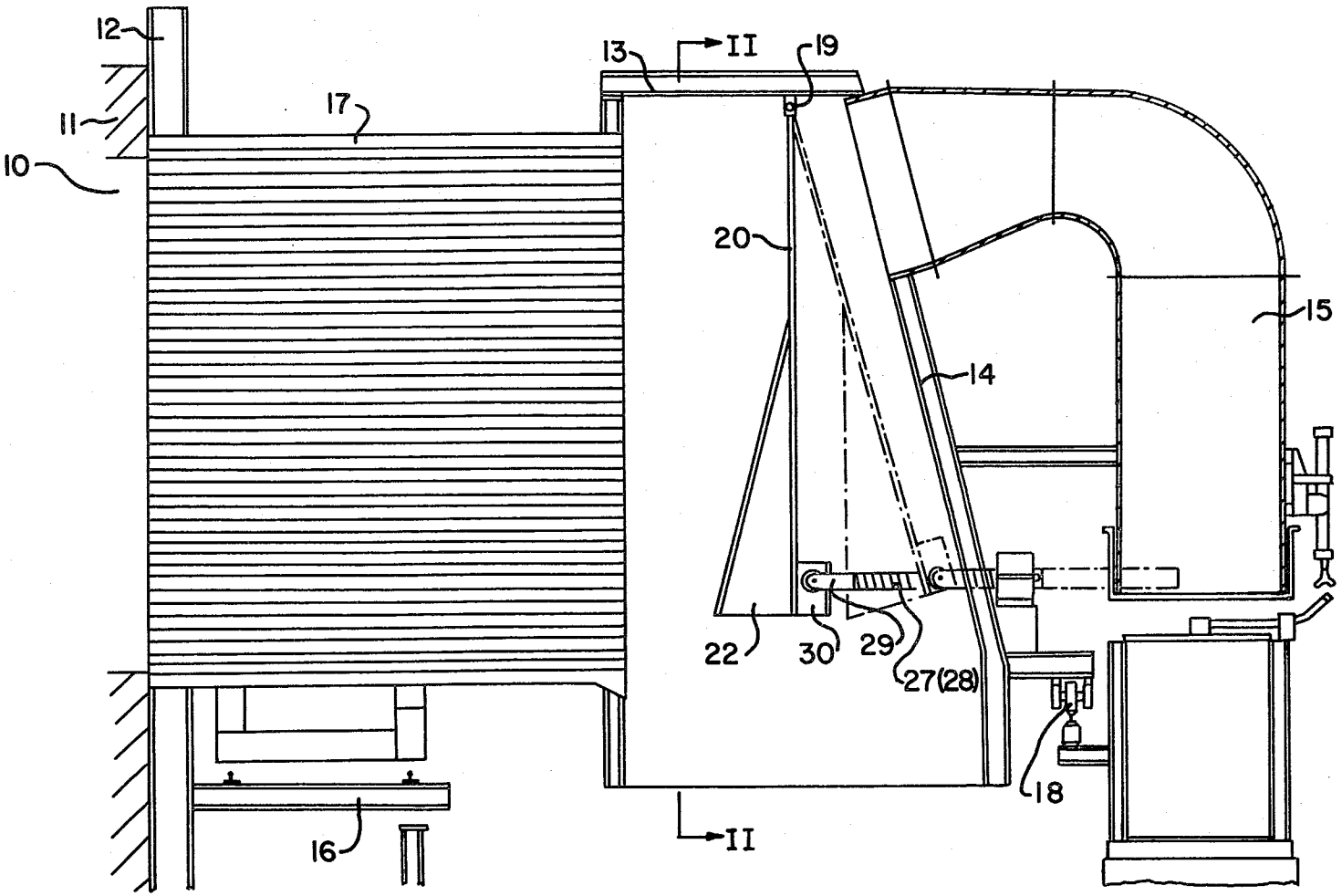
FIG. 1 is a vertical section through the central plane of an oven chamber to illustrate the apparatus for distributing hot coke pushed from the oven chamber according to the present invention.

In FIG. 1 of the drawings, reference numeral 10 identifies a horizontal coke oven chamber in a coke oven battery. The oven chamber includes a roof 11. Buckstays 12 which are arranged at a spaced-apart vertical relation along the coke oven battery support the masonry of the oven chambers. A smoke collector hood includes a roof 13 and a running gear 18 by which the hood is supported for traversing movement along a working platform 16. The hood includes an outer wall 14 joined with two side walls 25 and 26. The outer side wall 14 is joined with a smoke flue 15 that communicates with a smoke collecting main. A coke guide grid 17 is supported by the running gear on the working platform for traversing movement along the coke oven battery. A distributor member is suspended for pivotal movement from the roof 13 of the smoke collecting hood.

Figure 2:
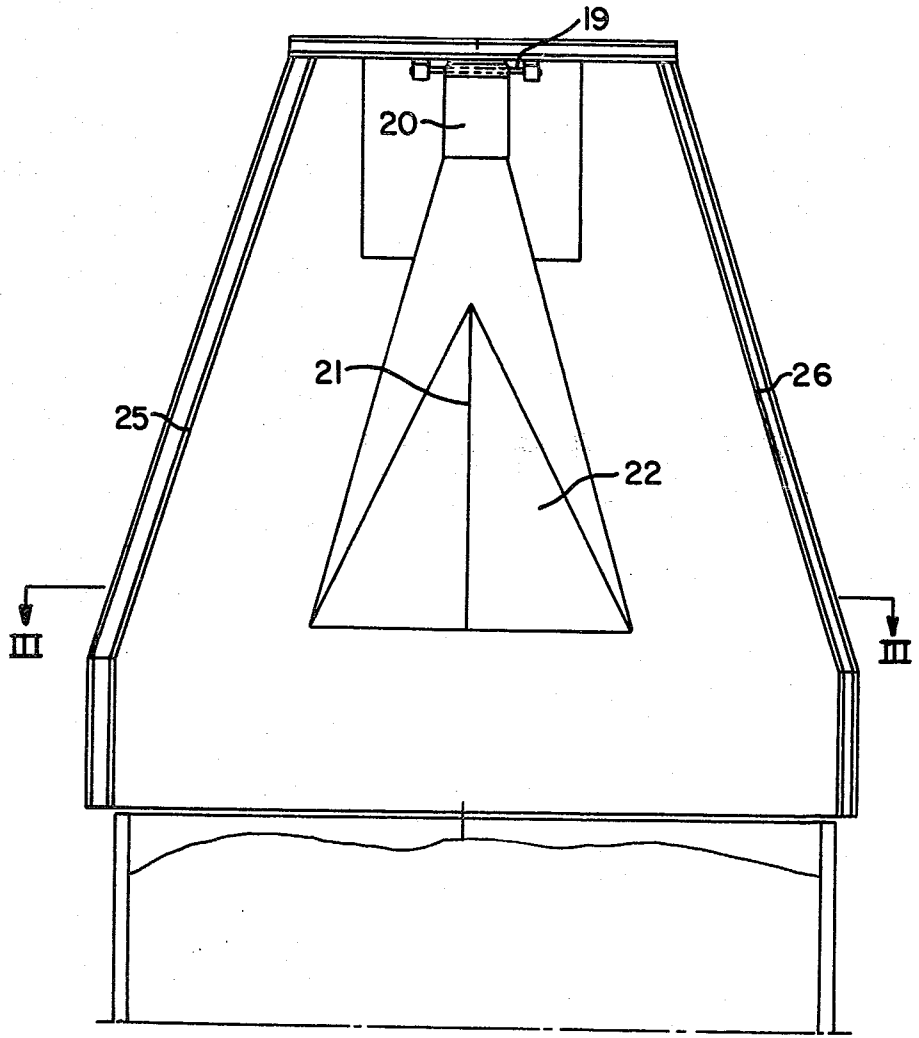
FIG. 2 is a sectional view taken along line II—II of FIG. 1.

As shown in FIGS. 1 and 2, the distributor member has a rectangular top part 20 connected to a pivot shaft 19 which is supported at its opposite ends by carriers that are attached to the roof 13 of the smoke hood. The rectangular top part 20 of the distributor member extends downwardly to a point where the distributor widens outwardly in a downward direction. A bottom part of the distributor is formed by two metal sheets 22 that meet at a vertical edge 21 arranged such that the width of the distributor member at the bottom part increases in the downward direction.

Figure 3:
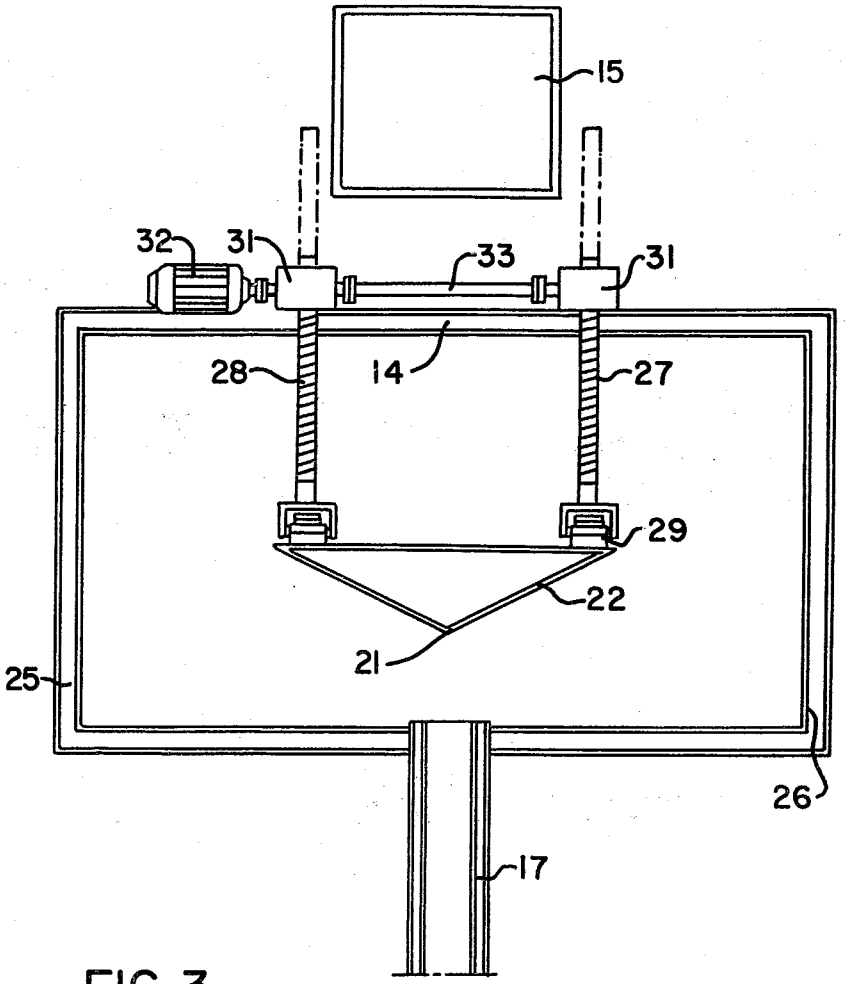
FIG. 3 is a sectional view taken along line III—III of FIG. 2.

Spindles 27 and 28, as best shown in FIGS. 1 and 3, support and guide the distributor member. The spindles have connection heads that include U-shaped hooks 29 used to support and guide the distributor member. The hooks 29 are pivotally mounted on brackets 30 which are fitted onto the back wall surface of the distributor member. Spindle drive elements 31 are mounted on the hood wall 14 to engage with the spindles 27 and 28 that extend through suitable openings in the hood wall. The drive elements 31 are connected to a motor 32 by shafts 33.

In the operation of the coke distributing apparatus of the present invention, a coke cake discharged from the coke cake guide grid comes into contact with the leading edge 21 of the distributor member whereby the coke cake is laterally deflected by the metal sheets 22. The deflected parts of the coke cake drop into front and rear positions of a coke car that is positioned below the smoke collecting hood. After most of the coke cake has dropped into the front and rear portions, the distributor member is pivotally moved such that the metal sheets recede from the coke oven chamber so that the remainder of the coke cake drops into the middle part of the coke car, thus insuring a uniform stratification of coke in the car.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. Apparatus to distribute a hot coke cake pushed from an oven chamber in a coke oven battery, said apparatus being in combination with a coke car, an oven chamber and a coke guide arranged to direct a hot coke cake from the oven chamber for passage into said coke car at the coke side of the oven chamber, said apparatus including a smoke collector hood having a roof at the coke discharge side of said coke guide generally above the path of travel by a coke cake passed therefrom, a distributor suspended from said smoke collector hood, said distributor including a front wall with metal sheets receding from a middle vertical edge spaced outwardly from said coke guide and facing toward the oven chamber to laterally deflect a coke cake passing from said coke guide beneath said hood, and means to pivotally support said distributor for moving away from the coke oven battery outwardly of the path of the coke cake.

2. The apparatus according to claim 1 further comprising actuator means supported on the outside of said smoke collector hood for pivoting said distributor.

3. The apparatus according to claim 2 wherein said actuator means includes a linkage coupled to said distributor on the side thereof remote to said oven chamber, said smoke collector hood including an outer side wall through which said linkage extends, and means on said outer side wall to engage with said linkage for pivoting said distributor.

4. The apparatus according to claim 3 wherein said linkage includes a pair of spindles extending through said outer side wall for pivotal engagement with said distributor.

5. The apparatus according to claim 1 wherein said distributor includes metal sheets forming a front wall receding from a middle vertical edge and widening outwardly and downwardly under said smoke collector hood.

* * * * *